United States Patent [19]

Bredeweg

[11] Patent Number: 4,967,500

[45] Date of Patent: Nov. 6, 1990

[54] SNAP-ON INFORMATION DISPLAY PANEL FOR GARMENT HANGERS

[75] Inventor: Robert A. Bredeweg, Zeeland, Mich.

[73] Assignee: Batts, Inc., Zeeland, Mich.

[21] Appl. No.: 197,599

[22] Filed: May 23, 1988

[51] Int. Cl.[5] ..... G09F 3/00

[52] U.S. Cl. ..... 40/322; 40/658; 40/666

[58] Field of Search ..... 40/322, 666, 658; D6/326, 328; D20/43; 223/91, 93, 96

[56] References Cited

U.S. PATENT DOCUMENTS

| | | | |
|---|---|---|---|
| 179,476 | 7/1876 | Hearttagen | 40/658 |
| 1,285,890 | 11/1918 | Anderson | 40/658 |
| 1,332,941 | 3/1920 | Anderson | 40/658 |
| 1,745,942 | 2/1930 | Miley | 40/658 |
| 2,288,071 | 6/1942 | Cohen | 40/322 |
| 2,938,252 | 5/1960 | Schumaeker | 40/658 |
| 4,718,581 | 1/1988 | Chiaramonte | 223/96 |

*Primary Examiner*—Cary E. Stone

*Attorney, Agent, or Firm*—Price, Heneveld, Cooper, DeWitt & Litton

[57] ABSTRACT

An information display device has a display surface supported on a leg from the lower end of which one or more finger elements extend at a right angle to the display surface to detachably or permanently secure it to one of the jaws of a garment clamping hanger. The finger elements engage the rear jaw of the garment clamp in such a manner that the clamp will remain erect during handling of the hanger and its load and will not interfere with the loading and unloading of the hanger. While the fingers extend the length of the hanger, the display surface is positioned at a right angle thereto so the information of its display surface is visible from the end of the hanger.

24 Claims, 4 Drawing Sheets

SNAP-ON INFORMATION DISPLAY PANEL FOR GARMENT HANGERS

FIELD OF THE INVENTION

The invention relates to a means for mounting an information display panel to one clamp of a garment clamping hanger.

BACKGROUND OF THE INVENTION

Many garments are displayed in retail stores when suspended from a garment hanger which clamp one end of the garment. Typical hangers used for such displays are molded of plastic and are exemplified by the hangers described in U.S. Pat. Nos. 3,698,607 entitled GARMENT CLAMPING HANGER, issued Oct. 17, 1972 and 3,767,092 entitled GARMENT CLAMPING HANGER WITH SLIDABLE LOCKING CLIP, issued Oct. 23, 1973.

Such hangers are used to display slacks, pants, skirts, shorts and swimming trunks, for example. They are also used to display items other than apparel such as towels, napkins and similar fabric items. Garments displayed for sale are normally displayed on rectangular or circular racks with the garments so supported that only the ends of the hangers are visible to the customer unless the hanger and garment are removed from the rack. While it is common practice to divide the rack into zone separated by size markers with each zone devoted exclusively to one size, this practice frequently experiences difficulty due to customers removing a garment with the hanger attached and later returning it to the rack in a different size zone. If each hanger and its garment were individually identified as to size, subsequent customers would be immediately informed and would be less inconvenienced. It also would be advantageous to store management to be able to accurately determine the stock condition of each size without having to make a garment-by-garment inventory check. There are various other circumstances in both the handling and the display of garments hung from these clamp type hangers where individual size information displayed at the end of the hanger would be a convenience to both customer and the sales staff. Particularly would these be true after a very active customer period when numerous garments have been taken down and were not promptly rehung.

BRIEF DESCRIPTION OF THE INVENTION

The invention provides a compact, inexpensive information display device which can be attached to the conventional molded plastic, garment clamping hanger without requiring the hanger to be specifically designed to mount it. It can be made to be either permanently or removably attached. The display panel can either have the information permanently applied to it or the information can be made changeable at will, such as by use of a removable peel-off label attached to the display face of the panel.

DESCRIPTION OF THE PREFERRED EMBODIMENT

Figure 1:
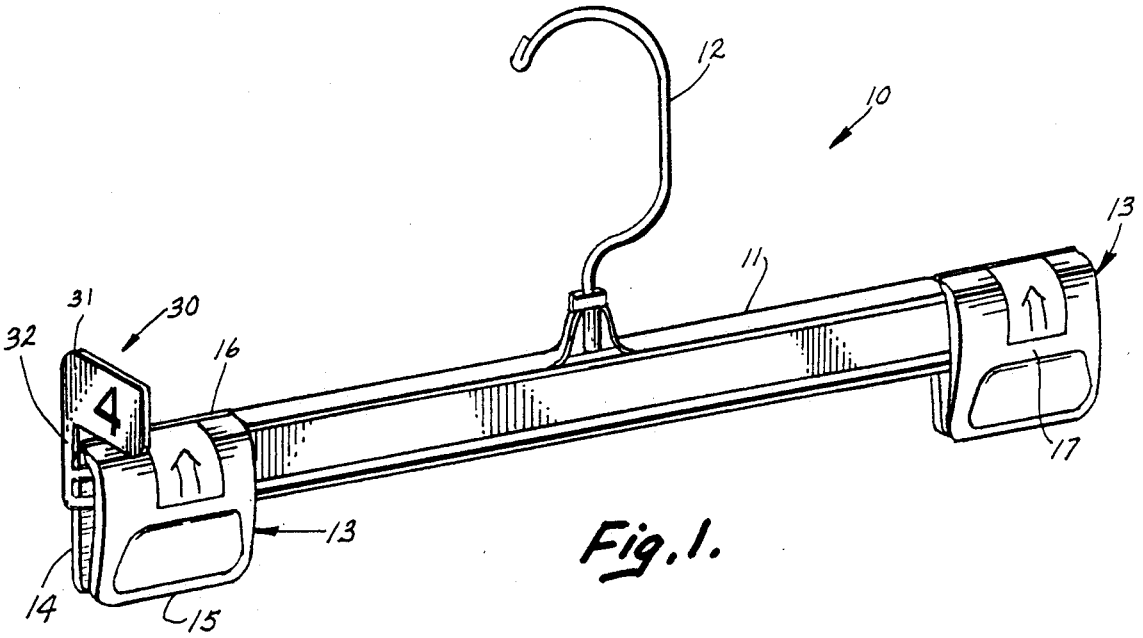
FIG. 1 is an oblique front view of a hanger to which this invention has been applied.
Figure 9:
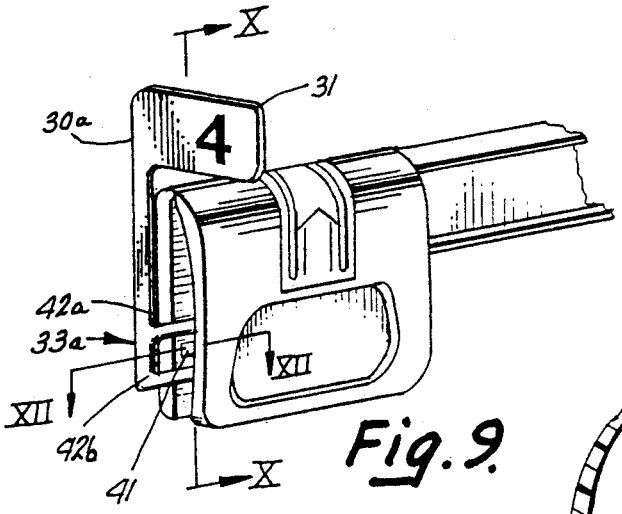
FIG. 9 is a fragmentary oblique front view of a modification of the invention.
Figure 14:
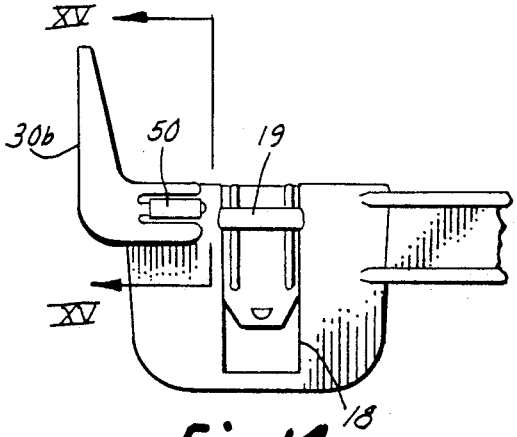
FIG. 14 is a fragmentary oblique rear view of the invention illustrated in FIG. 13.

Referring to FIG. 1, the numeral 10 identifies a clamping hanger having an elongated, beam-like body 11 supported at the center by a hook 12. At each end of the body a garment gripping clamp 13 is provided. The clamps 13 each have a rear leg or jaw 14 and a front leg or jaw 15. The jaws 14 and 15 are pivotally joined at the top by a hinge 16. The rear jaw, in most of the hangers to which this invention is designed to be applied is integral with the beam-like hanger body and, therefore, only the front jaw pivots. The clamps and the body are all molded as a single integral structure from a suitable plastic, such as polypropylene. The hook 12 can also be of plastic and molded integrally with the body or it may be made of wire and suitably attached to the body in any of the various ways commonly practiced in the garment hanger industry. As is disclosed in U.S. Pat. No. 3,767,092 entitled GARMENT CLAMPING HANGER WITH SLIDABLE LOCKING CLIP, issued Oct. 23, 1973, the front jaw is secured in closed, garment clamping position by a vertically slidable spring clip, one leg of which slides vertically in the front track 17 (FIG. 1) and the rear track 18 (FIG. 14) and when in raised or release position is held against complete release by the cross bar 19. Another conventional means for securing the front jaw in closed position is disclosed in U.S. Pat. No. 3,698,607 entitled GARMENT CLAMPING HANGER, issued Oct. 17, 1972. This invention can be used not only with either of these constructions but also with other clamp locking designs.

Figure 5:
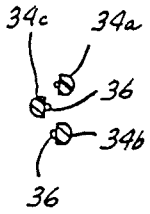
FIG. 5 is a sectional view taken along the plane V—V of FIG. 6.
Figure 6:
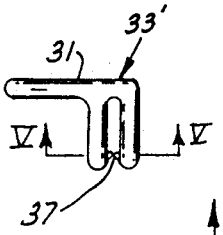
FIG. 6 is a bottom view taken along the plane VI—VI of FIG. 2.
Figure 2:
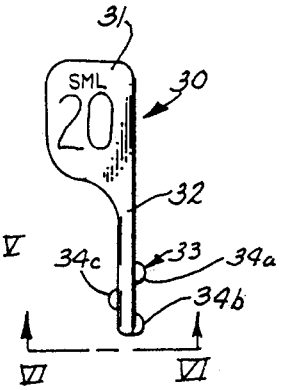
FIG. 2 is an end elevation view of one of the information display devices.
Figure 4:
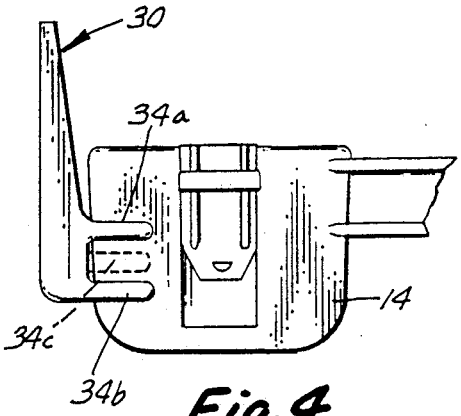
FIG. 4 is an enlarged, fragmentary rear view of one end of the hanger illustrated in FIG. 1 to which the invention has been applied.
Figure 3:
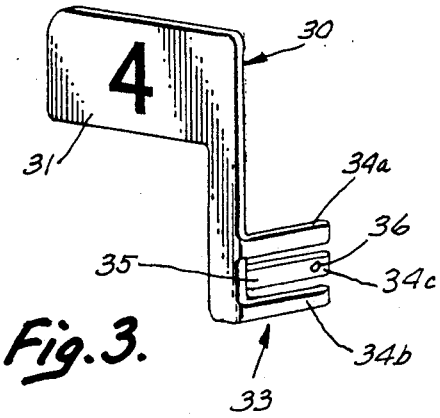
FIG. 3 is an oblique view of an information display panel.

The information display member or panel 30 of this invention has a flat display surface 31. A body member or leg 32 depends from the panel 30 (FIGS. 1, 2 and 3). At the lower end of the leg 32 an anchor means 33 is provided. The design of the anchor means depends in part upon the structure of the hanger with which it is to be used. When the panel is to be used with a hanger, the rear jaw of the clamp of which has no special aperture such as for anchoring an auxiliary rod or the like, the anchor means consists of at least three fingers 34*a*, 34*b* and 34*c* (FIGS. 3, 4 and 5). These fingers extend at a right angle to the display face of the board or panel 31 (FIG. 3). The fingers preferably each have a flat face 35 to seat against the surface of the rear clamp jaw. These fingers are arranged with the flat faces of the fingers 34*a* and 34*b* facing in the same direction and the flat face of the jaw 14 facing in the opposite direction. These faces are so spaced apart that they can be forcibly pushed onto the rear jaw of the clamp and provide sufficient frictional grip of the rear jaw to firmly anchor the panel 30 to the hanger. It is important that the jaw 14 be centered between the fingers 34*a* and 34*b* to hold the panel erect and in alignment with the rear jaw. It will be seen that, by this arrangement, the display surface and the information placed on it will be clearly visible to anyone looking lengthwise of the end of the hanger. Also, it will be observed from FIG. 1 that the display surface of the panel will be supported above the clamp. When the panel is above the clamp, since no portion of the garment projects above the clamp, the information on the display panel is not concealed by the garment even though portions of the garment extend beyond the clamp. Further, this arrangement eliminates interference between the garment and the panel.

While in many situations the frictional grip between the surfaces of the fingers 34*a* and *b* and the jaw of the clamp will be adequate, in some applications to retain the display panel 30, it is preferable to provide additional retention. For this purpose, the fingers may be equipped with detent projections 36 which engage in suitable sockets 37 in the face of the clamp's jaw (FIGS. 5–8). These detents will also resist displacement of the indicia panel which would render the panel no longer parallel with the end face of the hanger.

Also, by securing the indicia panel to the rear jaw of the clamp, the fingers and the vertical post or leg 32 by which the panel portion is supported normally will be concealed from the front behind that portion of the garment which extends beyond the clamp. Further, the indicia panel will not interfere with the attachment to or removal of the garment from the hanger.

Figure 12:
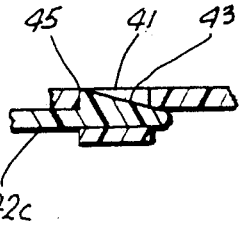
FIG. 12 is a fragmentary sectional view taken along the plane XII—XII of FIG. 9.
Figure 4A:
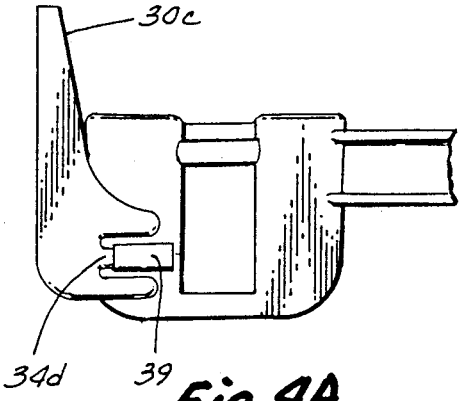
FIG. 4A is a view similar to FIG. 4 in which the display panel is designed to utilize an existing rearwardly extending socket.
Figure 13:
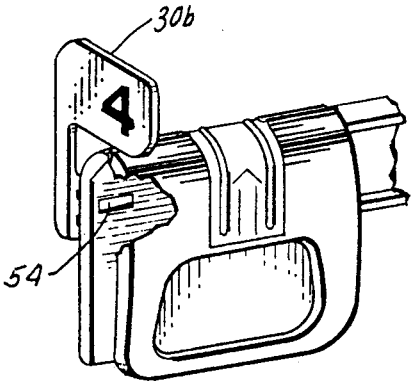
FIG. 13 is a fragmentary front oblique view of a modification of the invention.

FIG. 4A illustrates a modification of the arrangement illustrated in FIGS. 3–8. In this construction, all of the fingers are vertically aligned and seat against the rear face of the clamp jaw. In this construction, the rear jaw of the clamp has a rearwardly protruding socket 39 into which the middle finger 34*d* of the display panel 30*c* is inserted. The middle finger may have a smooth inner surface or it may have an arrowhead type of construction similar to that illustrated in FIG. 12 to lock the display panel 30*c* to the hanger.

Figure 10:
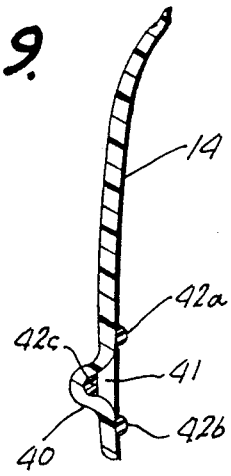
FIG. 10 is a sectional view of the rear jaw of the clamp taken along the plane X—X of FIG. 9.

FIGS. 9–12 illustrate a modified construction for this invention. Some hangers are molded with a rearwardly extending socket in the rear face. In the past, such sockets have been used to attach an auxiliary wire or molded plastic bar to the hanger. In the construction illustrated in FIGS. 9 and 10, the socket 40 is a rearwardly offset portion of the rear jaw forming a horizontal opening 41 preferably open at both ends. This opening also communicates through the front face of the jaw (FIG. 10).

In this construction, the indicia panel 30*a*, like the panel 30, has a display surface 31 at the top, a vertical leg at the lower end of which is an anchor means 33*a*. The leg is long enough to support the display surface 31 above the clamp. The anchor means has three fingers 42*a*, *b* and *c* which, like the fingers 34 and 34*b* and *c*, are vertically spaced. The fingers 42*a*, *b* and *c* are arranged vertically aligned and all may have a flattened surface facing the surface of the clamp jaw (FIG. 3).

The middle finger 42*c* can have a forwardly and outwardly inclined camming surface 43 (FIG. 12) which terminates in an offset forming a forwardly projecting catch 45 which, when the fingers are fully inserted, seats in the opening 41 (FIG. 12) in the rear jaw of the clamp. To mount the display panel or flag 30*a*, the finger 42 is forced through the opening 41 by flexing the plastic from which both the clamp and the display panel are molded until the catch enters the opening 41 and by the resilience of the material is snapped to seat in the opening. This securely locks the panel to the clamp positively holding the panel erect and with the display panel parallel to the end surface of the clamp. The flat surfaces on the fingers provide a positive stabilizing support for panel. Further, the catch prevents inadvertent separation from the clamp.

Figure 11:
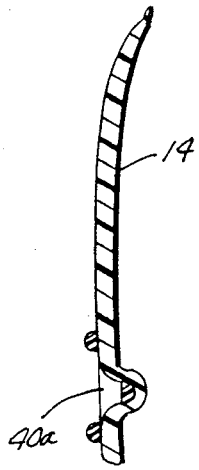
FIG. 11 is a sectional view similar to FIG. 10 illustrating a modified construction.
Figure 7:
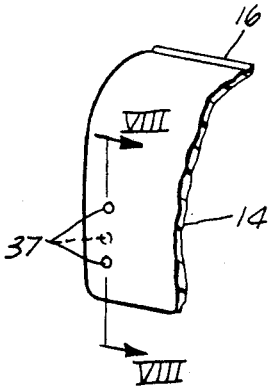
FIG. 7 is a fragmentary oblique view of the rear surface of the back leg of the clamp illustrated in FIG. 4 with the indicia panel removed.
Figure 8:
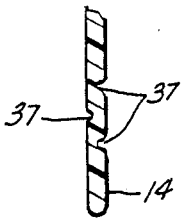
FIG. 8 is a fragmentary, sectional view taken along the plane VIII—VIII of FIG. 7.

FIG. 11 illustrates the construction as FIG. 10 except, in this case, the sock 40*a* is offset forwardly into the interior of the clamp. Because the inner faces of the fingers are flattened, this change would require left and right display panels.

Figure 15:
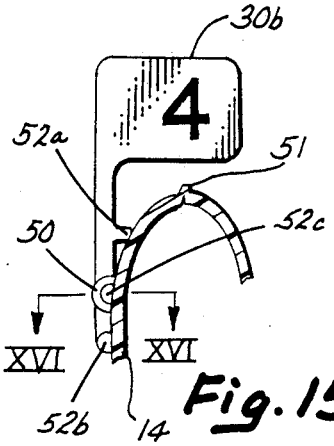
FIG. 15 is a fragmentary, enlarged sectional view taken along the plane XV—XV of FIG. 14.
Figure 16:
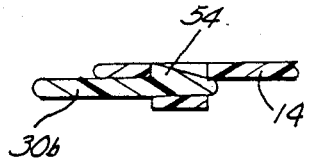
FIG. 16 is a fragmentary, section view taken along the plane XVI—XVI of FIG. 15.

FIGS. 13–17 illustrate a somewhat different arrangement for mounting a display panel 30*b* to a clamping hanger having a rearwardly offset socket. In this case, the socket is illustrated as being adjacent the top of the rear jaw. In this location, the socket 50 extends rearwardly from the clamp and is immediately adjacent that portion of the jaw of the clamp which curves sharply forward toward the hinge 51 (FIG. 15). In this construction, the middle finger 52*c* and the lower fingers 52*b* are the same as fingers 42*b* and 42*c* respectively, illustrated in FIGS. 9 and 10 with the finger 52*c* being inserted through the socket 50. The finger 52*c* can have a catch 54 similar to the catch 45 for positively locking the indicia panel to the hanger body (FIG. 16). This, however, does not provide a stable anchor because the panel could be pivoted forwardly. To prevent this the upper finger 52*a* is thicker in a forward direction so that it will make positive contact with the forwardly curved surface of the clamp's rear jaw and thus prevent pivoting about the middle finger 52*c*. If the middle finger 52*c* does not have the catch, this arrangement is clearly essential for stability. If the unit is so designed that it makes the positive contact shown in FIG. 15, the panel will be positively stabilized. The upper finger 52*a* is preferably wedge shaped to facilitate installation and also to assure sufficient contact and a camming action with the jaw's back surface to provide adequate bearing.

Figure 18:
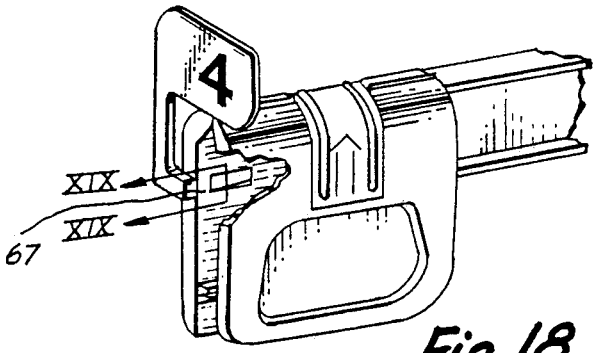
FIG. 18 is a fragmentary, oblique front view of another modification of this invention.
Figure 20:
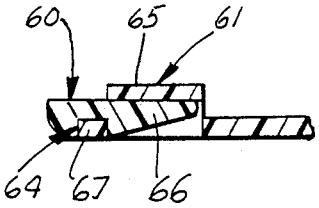
FIG. 20 is a fragmentary, sectional view taken along the plane XX—XX of FIG. 19.
Figure 19:
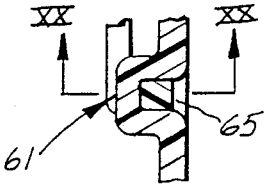
FIG. 19 is an enlarged fragmentary, sectional view taken along the plane XIX—XIX of FIG. 18.

The display panel illustrated in FIGS. 18–20 has only a single finger 60 extending from its lower end. It is designed for use with a clamp having a socket 50 similar to that illustrated in FIGS. 14–17 but more square in cross section. The finger 60 is long enough to extend the full length of the socket 65 and is provided with a vertical face on its rear face 61 which seats against the inner or forward face of the socket 65 (FIG. 19). This engagement resists rotation of the finger about its central axis It also has an abutment 64 adjacent the end edge of the panel which serves as a stop against further insertion of the finger 60 into the socket 50. Spaced from the abutment 64, the length of the socket 40 is a catch 66 similar in construction to the catch 45 which engages the outer end of the socket 65 and in cooperation with the abutment 64 traps the strap-like portion 67 of the rear jaw between the outer end of the socket and the outer edge of the jaw. The end of the finger has a forwardly facing ramp so it can be pushed through the socket. Once pushed through, it locks the indicia panel from being withdrawn. By so designing, the size of the socket opening with respect to the size of that portion of the finger which becomes trapped in the socket, enough pressure can be generated to positively hold the flat inner surface of the finger against the back face of the strap 67 and the flat outer surface against the inner surface of the socket and in cooperation with the upper and lower surfaces of the catch engaging the top and bottom sides of the socket positively hold the panel against rotation about the axis of the finger 60.

Figure 21:
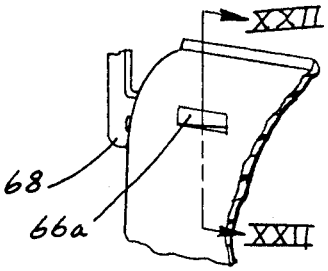
FIG. 21 is a fragmentary oblique rear view of a further modification of the invention.
Figure 17:
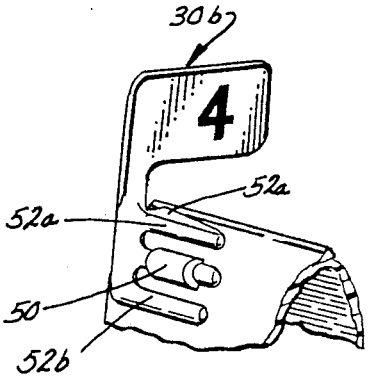
FIG. 17 is a fragmentary oblique rear view of the invention illustrated in FIGS. 14–16.
Figure 23:
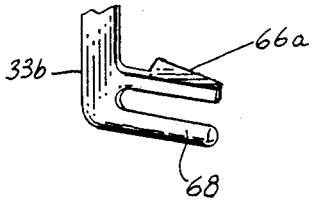
FIG. 23 is a fragmentary oblique view of the anchor portion of the display device shown in FIG. 22.
Figure 22:
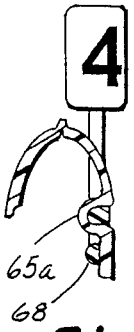
FIG. 22 is a fragmentary sectional view taken along the plane XXII—XXII of FIG. 21.

FIGS. 21–23 illustrate a further modification in which the anchor means **33*b* has only two fingers. It is designed to be mounted in the same location as the display device illustrated in FIGS. 13–17 but using a socket 65*a* which extends inwardly. The upper finger has a catch 66*a* which faces rearwardly and because of the bearing between the sides of the catch and the top and bottom walls of the socket the display device is positively held in erected position. The lower finger 68** seats against the inner face of the clamp jaw and cooperates with the catch in keeping the display device properly erected.

The hanger body, including the clamps, can be molded from a suitable plastic, such as polypropylene. The individual flags or display panels can be molded of any suitable plastic, such as polypropylene or styrene. The indicia panels may have the indicia printed on them or molded into them in such a manner that the information is displayed in contrasting colors. A more versatile manner of providing the necessary information would be to apply adhesive backed, printed labels to the panel. The choice of how the information is provided on the panels is not part of the invention.

Having described a preferred embodiment of this invention, together with several modifications thereof, it will be recognized that other modifications can be made without departing from the principles of the invention. Such modifications are to be considered as included in the hereinafter appended claims, unless these claims, by their language, expressly state otherwise.

I claim:

1. An information display panel for a garment clamping hanger, the garment clamp of said hanger having a rear jaw, said panel having an upstanding body member with a display surface arranged in a vertical plane extending therefrom at one end and an anchor element at the other end arranged in a vertical plane and extending at a right angle to said display surface, said anchor element having finger means vertically arranged parallel to the plane of said rear jaw and extending parallel to and transversely of said one jaw for engaging said one jaw for holding said display surface erect and normal to the plane of the forward face of the rear jaw.

2. The information display panel described in claim 1 wherein said finger means includes three vertically spaced fingers extending from said body member in a direction normal to said display surface.

3. The information display panel described in claim 2 wherein one of said fingers is offset from the other two fingers in a direction normal to the width a clamp's rear jaw and extends parallel to the lengthwise direction of said other fingers whereby the fingers are adapted to engage both the front and rear faces of a clamp jaw.

4. The information display panel described in claim 2 wherein said fingers have jaw engaging means on their jaw engaging surfaces.

5. The information display panel described in claim 1 wherein said finger means includes a finger having a shoulder extending outwardly from the finger parallel to the display surface, the front and back faces of said finger tapering toward each other in a direction from said shoulder away from said display.

6. The information display panel described in claim 5 wherein said finger means includes another finger parallel to said finger and in the same vertical plane as said finger.

7. The combination described in claim 1 wherein said display surface is supported above the top of said clamp.

8. In combination, a garment hanger and an information display member, said hanger having front and rear jaws pivotably joined at their top forming a clamp, said member having an upstanding body element with a panel forming a display surface on one end and an anchor element on the other end said panel extending from said body element at a right angle to said anchor element, said anchor element having finger means engaging said rear jaw for holding said display member erect.

9. The combination described in claim 8 wherein said finger means includes three vertically spaced fingers, the middle one of said fingers engaging the surface of said rear jaw opposite from the surface of said rear jaw engaged by the other two of said fingers whereby said display panel is supported in erected position.

10. The combination described in claim 8 wherein said rear jaw and fingers have interengaging detent means for stabilizing the position of fingers with respect to said rear jaw.

11. The combination described in claim 8 wherein said rear jaw has a portion forming an elongated socket projecting rearwardly of the rear face of said rear jaw, said middle finger being seated in said socket.

12. The combination described in claim 11 wherein said socket is formed by displacement rearwardly of a portion of said rear jaw and said socket opens through said rear jaw into the interior of the clamp.

13. The combination described in claim 12 wherein said middle finger has a wedge-shaped catch thereon forming a shoulder facing toward said panel, said catch extending into said opening for holding said finger from axial release from said socket.

14. The combination described in claim 12 wherein said socket is adjacent the top of said rear jaw.

15. The combination described in claim 14 wherein the top of said jaw above said socket is arched forwardly, the upper one of said fingers having a forwardly extending portion such that it seats firmly against said arched surface to hold said panel upright.

16. The combination described in claim 15 wherein said middle finger has a wedge-shaped catch thereon extending into said opening formed by said socket for holding said finger from release from said socket.

17. The combination described in claim 12 wherein said socket is adjacent the lower end of said rear jaw, said panel and said body element being elongated for supporting the panel above the top of the clamp.

18. The combination described in claim 8 wherein said rear jaw has a forwardly extending portion forming an elongated socket inwardly of the rear face of said rear jaw and communicating through said rear jaw to the back of said clamp, said middle finger being seated in said socket.

19. The combination described in claim 8 wherein said rear jaw has a portion displaced rearwardly of the rear face of said jaw and opening through said rear jaw into the interior of the clamp to form a socket, the end of said socket adjacent the edge of said rear jaw being spaced from the edge to form a strap therebetween, said finger means having flat surfaces seated against the exterior face of said strap and the inner face of said socket; said displaced portion having sufficient resilience to press tightly against the rear face of said finger and force said flat surface against said rear jaw; said finger having a tapered inner face forming an inwardly directed abutment seated against the end of said opening adjacent the edge of the jaw for holding said finger against displacement axially of the socket, a shoulder on said finger facing said abutment and in cooperation with said abutment forming a recess for receiving and trapping said strap therebetween.

20. An information display panel adapted to be secured to one leg of a clamp of a garment clamping hanger, the clamp of the hanger having front and rear jaws hinged at the top, said panel having a display surface, a depending leg and an anchor means at and extending from the lower end of the leg, said anchor means extending from said leg substantially at a right angle to said display surface, said anchor means having three fingers spaced apart lengthwise of said leg, said fingers forming a channel between them wherein they can be telescoped over the outer edge of one of said jaws with two of the fingers engaging one surface of the jaw and the other finger engaging the opposite surface thereof with sufficient friction to positively support said indicator panel in erected position.

21. An information display panel for use with a garment hanger having a pair of garment clamping jaws, said panel having a flat surface for displaying information thereon, a vertical leg for supporting said surface, an anchor element extending away from said surface in the plane of said jaws at the lower end of said leg for frictionally engaging one of the jaws of said hanger and holding said leg substantially vertical, with said surface extending normal to the plane of said jaws and to the anchor element engaging said jaws, said anchor element having means thereon preventing the leg from pivoting in a fore or aft direction with respect to the transverse axis of the hanger.

22. An information display member for use with a garment hanger having a depending garment engaging jaw, said display member having an elongated surface to provide a space for indicia which surface is designed to permit the indicia to be read when viewed lengthwise of the hanger body, said display panel having a vertical leg for supporting said surface, an anchor element at the lower end of said leg for frictionally engaging an end of the hanger, said anchor element including means arranged in a vertical plane and extending away from said flat surface and lengthwise of the hanger for frictionally engaging and anchoring said display member to the hanger with said surface normal to the end of the hanger body, said display member holding said surface above the body of the garment hanger.

23. An information display panel as described in claim 22 wherein said means on said anchor element has three vertically spaced fingers, the middle one of which has a hanger engaging surface facing oppositely to the hanger engaging surfaces of the other fingers.

24. An information display panel as described in claim 23 wherein said anchor element has interlocking means thereon for engaging the hanger to prevent detachment of the display panel from a hanger.

* * * * *

UNITED STATES PATENT AND TRADEMARK OFFICE

CERTIFICATE OF CORRECTION

PATENT NO. : 4,967,500

DATED : November 6, 1990

INVENTOR(S) : Robert A. Bredeweg

It is certified that error appears in the above-identified patent and that said Letters Patent is hereby corrected as shown below:

Column 1, line 29:
"zone" should be -- zones --.
Column 4, line 38:
After "the" insert -- same --.
Column 4, line 39:
"sock" should be -- socket --.
Column 5, line 11:
After "axis" insert -- . --.

Column 8, line 2:
"wherein" should be -- whereby --.

Signed and Sealed this

Twenty-first Day of July, 1992

*Attest:*

DOUGLAS B. COMER

*Attesting Officer*

*Acting Commissioner of Patents and Trademarks*